US006435395B1

(12) United States Patent
Miyaguchi et al.

(10) Patent No.: US 6,435,395 B1
(45) Date of Patent: Aug. 20, 2002

(54) POST PROCESSOR FOR THE IMAGE FORMATION MACHINE

(76) Inventors: Kunihiko Miyaguchi; Naomi Kusakabe; Hiroshi Kameyama, all of 1945 Dota, Kanishi, Gifu 509-02 (JP)

( * ) Notice: Subject to any disclaimer, the term of this patent is extended or adjusted under 35 U.S.C. 154(b) by 0 days.

(21) Appl. No.: 09/075,369

(22) Filed: May 11, 1998

(30) Foreign Application Priority Data

Jun. 2, 1997 (JP) ..... 9-160512
Jun. 16, 1997 (JP) ..... 9-176342
Jun. 16, 1997 (JP) ..... 9-176343

(51) Int. Cl.[7] ..... B27F 7/00
(52) U.S. Cl. ..... 227/27; 83/162; 83/106; 83/110; 83/687; 83/86
(58) Field of Search ..... 83/110, 156, 167, 83/106, 102, 627, 423, 107, 105, 162, 687, 86

(56) References Cited

U.S. PATENT DOCUMENTS 2,245,108 A * 6/1941 Kottmann ..... 83/423
3,665,796 A * 5/1972 Witte ..... 83/156
3,902,954 A * 9/1975 Lotto ..... 83/156
4,014,233 A * 3/1977 Wolfinger et al. ..... 83/156
4,557,169 A * 12/1985 Kayiya et al. ..... 83/156
4,941,377 A * 7/1990 Ishihara et al. ..... 83/211
5,031,495 A * 7/1991 Kogane et al. ..... 83/156
5,253,030 A * 10/1993 Shigemura et al. ..... 83/167
5,509,645 A * 4/1996 Shinno et al. ..... 83/156
5,793,298 A * 8/1998 Matsura ..... 83/167
6,014,920 A * 1/2000 Yamauchi et al. ..... 83/560

FOREIGN PATENT DOCUMENTS

FR 2304452 * 10/1976 ..... 83/156

* cited by examiner

*Primary Examiner*—Kenneth E. Peterson
*Assistant Examiner*—Omar Flores Sänchez
(74) *Attorney, Agent, or Firm*—William C. Cray

(57) ABSTRACT

Sheet post processing apparatus is disclosed in a compact form for receiving from an image forming machine successive sheets of printed material and performing post processing thereto, by feeding sheets into the apparatus at the output speed of the image forming machine, by stopping the leading edge of the sheets by feed rolls, performing a first post process on the sheet, upstream of the feed rolls, then feeding the processed sheet, by said feed rolls, at a higher speed by either a bypass path to a receiver or through a divergent path by a diverter to an inclined tray beneath the first processor for performance of a different post process and then from the inclined tray to a stacker by an additional output feed associated with the inclined tray.

5 Claims, 9 Drawing Sheets

POST PROCESSOR FOR THE IMAGE FORMATION MACHINE

BACKGROUND OF THE INVENTION

This invention regards a post processor that receives the sheets, onto which the image has already been recorded and which are discharged from image formation machines, such as printers, copiers, facsimile machines, and printing presses, and fed into the post processor, and that discharge the sheets after the necessary processing inside.

There have been, in the prior art, post processors that take the sheets onto which the image has already been recorded and which are discharged from the image formation machines such as printers and copiers and that discharge the sheets after the necessary processing such as sorting, inverting and punching and/or binding inside the post processor.

By incorporating a perforator or punch into the post processor, sheets can be perforated or punched. In order to do so, the post processor takes sheets in completely and stops them, and the perforator is placed where its perforation point meets the stopped sheet. However, since this structure requires a large space for taking and stopping the sheets, the size of the post processor may be enlarged.

On the other hand, if the post processor stops sheets before completely taking them inside, that is, to stop them while the image formation machine holds the latter half of the sheets, the size of the post processor can be minimized. However, in that case, since the control of the image formation machine needs to be changed to stop the sheets, the cost of initializing a post processor increases and it cannot be used for the existing image formation machines.

The post processor with a sheet inverting function can rotate sheets half way without damaging them. Upon such basic performance as a premise, it is desirable for the post processor to be very compact, not to require too much installation space and to maintain low cost.

Therefore, the post processor conventionally receives the sheets discharged from the image formation machine at the specified speed and discharges the sheets after the processing such as binding. This requires the processing capability with the speed not to disturb the sheet output timing of the image formation machine.

In order to do so, the transporting speed of the sheets inside of the post processor is set up to be higher than the speed of the image formation machine to create necessary processing time. However, since the sheet transporting structure in the post processor is typically designed to have several feed rollers placed at intervals that are shorter than the length of the sheets, the transporting speed of all sending rollers needs to be generalized. Therefore, it has been considered difficult to set up the transporting speed in the post processor higher than the sheet infeed speed of the image formation machine.

SUMMARY OF THE INVENTION

In view of the above, an object of the present invention is to provide a post processor that is compact and inexpensive while being equipped with a post processing function and that can be installed in conjunction with the existing image formation machines.

In order to achieve the above objective, this invention provides the post processor for an image formation machine that receives the sheets discharged from the image formation machine with infeed means and which discharges them after the necessary processing inside, wherein gate means to stop the leading edge of moving sheets in the middle of the sheet feed path, and that locates the automatic punch to punch holes in the specified position close to the front edge of the temporarily stopped sheets, and has a free space to enable the sheets to bend in front of the automatic punch.

The above post processor stops the front end of the sheets by the gate means and punches the sheets by the punch means while the image formation machine continues to feed sheets regardless of the functions of the post processor. The latter half of the sheet is sent toward the post processor even during the punching or other post processing. Therefore, the middle portion of the sheet bends in a loop and the sheet escapes into a free space since only the front end of the sheet is stopped by the gate means during the punching process.

Then, the post processor restarts feeding sheets after the completion of the punching process.

The feed rollers can be established in the middle of the sheet feed path and can be used as the aforementioned gate means by turning on and off the feed rollers. By doing so, it is cost effective because the gate means does not have to be separately provided.

The above feed rollers should be structured with two driving rollers facing each other. If the feed rollers are formed by two driving rollers like this, the resistance increases while the sending rollers stop, and the rollers become less likely to idle when the sheets contact the stopped rollers causing the sheets to stop at a certain position.

In order to achieve the above purpose, this invention provides a post processor for an image formation machine that has the feed path to take the sheets discharged from the image formation machine at the lead edge, to pass them through the machine, and to discharge them from the output from the post processor.

An inclined tray is located in the area directly underneath the feed path to incline the leading edge of the sheets downwardly to a sheet stopper on the lower end of the tray, a sheet transporting means to discharge the sheets placed on the inclined tray to an output portion of the post processor, a divergent feed path to feed the sheets from the middle of the aforementioned feed path onto the inclined tray, and a diverter located at the connection of the aforementioned feed path and the diverging path to alternatively switch the flow path to the output path or the diverging path, and that sets up the angle of the sheet and the higher side of the inclined tray to be acute when the sheets sent from the aforementioned diverging path move from the higher side to the lower side of the tray by being guided by the inclination of the inclined tray and stop when they hit the sheet stopper.

The above post processor receives the sheets discharged from the image formation machine at the lead end, passes them through the machine and discharges them from the output when the diverter opens the bypass path. On the other hand, when the diverter opens the diverging path, the sheets discharged from the image formation machine enter into the infeed path and flow onto the inclined tray from the bypass path through the diverging path. Since the angle of the sheet and the higher side of the inclined tray is set up to be acute when the sheets fed from the diverging path touch the inclined tray, the sheets entering into the inclined tray from the diverging path flow naturally from the higher end to the lower end along the inclination of the inclined tray and stop when they hit the sheet stopper. The sheets are reversed or inverted at this stage. Then, the sheet transporting means activates to push back and discharge the sheets placed on the top of the inclined tray.

The diverging feed means should be formed to force the sheets out toward the inclined tray in the aforementioned diverging path and to let the front end of the sheets reach the sheet stopper of the inclined tray before the diverging feed means releases the rear end of the sheets. By doing so, the front end of the sheets accurately reaches at the sheet stopper at high speed and the edges of the sheets can be aligned nicely. In a natural dropping method, first it takes time for the sheets to reach the sheet stopper and to stabilize themselves, and the sheets may stop in the middle of the process and the lead edges do not match.

A runner should be incorporated into a part of the diverging feed means and kick out the rear of the sheets onto the inclined tray. By doing so, high speed processing can be done without letting the trailing end of the sheet touch the leading end of the following sheet.

The punch should be located in front of the aforementioned diverter and enables punching the sheets between the infeed portion of the paper path and the diverter. By doing so, the punch can perforate both the sheets that passes through the feed path and the sheets that are supplied to the inclined tray in an inverted condition.

A cut off portion can be formed in a part of the aforementioned inclined tray and a stapler can be established to fit the cut off portion. By doing so, the sheets placed on the inclined tray according to the page number by inverting them on the tray can be bound by the stapler.

A tray guide should be formed above the aforementioned inclined tray and a deformed portion should be formed in either or both the inclined tray and/or the tray guide to correspond to the cut off portion. Thus, the gap between them becomes narrower by focusing around the cut off portion. By doing so, the stapler can easily bind the sheets because the thickness of a batch of sheets is tightened and reduced by the deformed portions. Since the deformed portions are partial and the resistance to the sheet decreases, the sheets can be inserted into or discharged from the deformed portions smoothly.

The post processor has the one way clutch mechanism associated with the infeed rollers to feed the sheets almost at the same speed as the output speed of the image formation machine. High speed rollers located behind the infeed rollers which have a sheet feeding speed higher than that of the aforementioned infeed rollers, and to cause the infeed rollers to move along with the sheets when the transporting speed of the sheet surpasses the infeed speed of the infeed rollers occurs.

In the aforementioned post processor, the sheets sent by the infeed rollers are put between the high speed rollers and forcefully pulled in when the sheets reach the high speed rollers. On the other hand, since the infeed rollers are equipped with the one way clutch mechanism, the transporting speed of the sheets that are fed by the high speed rollers surpasses the sending speed of the infeed rollers occurs, and the infeed rollers change speed to move along with the sheets.

The structure of the high speed rollers should have two power rollers facing each other. By doing so, the high speed rollers can send the sheet assuredly.

DESCRIPTION OF THE PREFERRED EMBODIMENT

Figure 1:
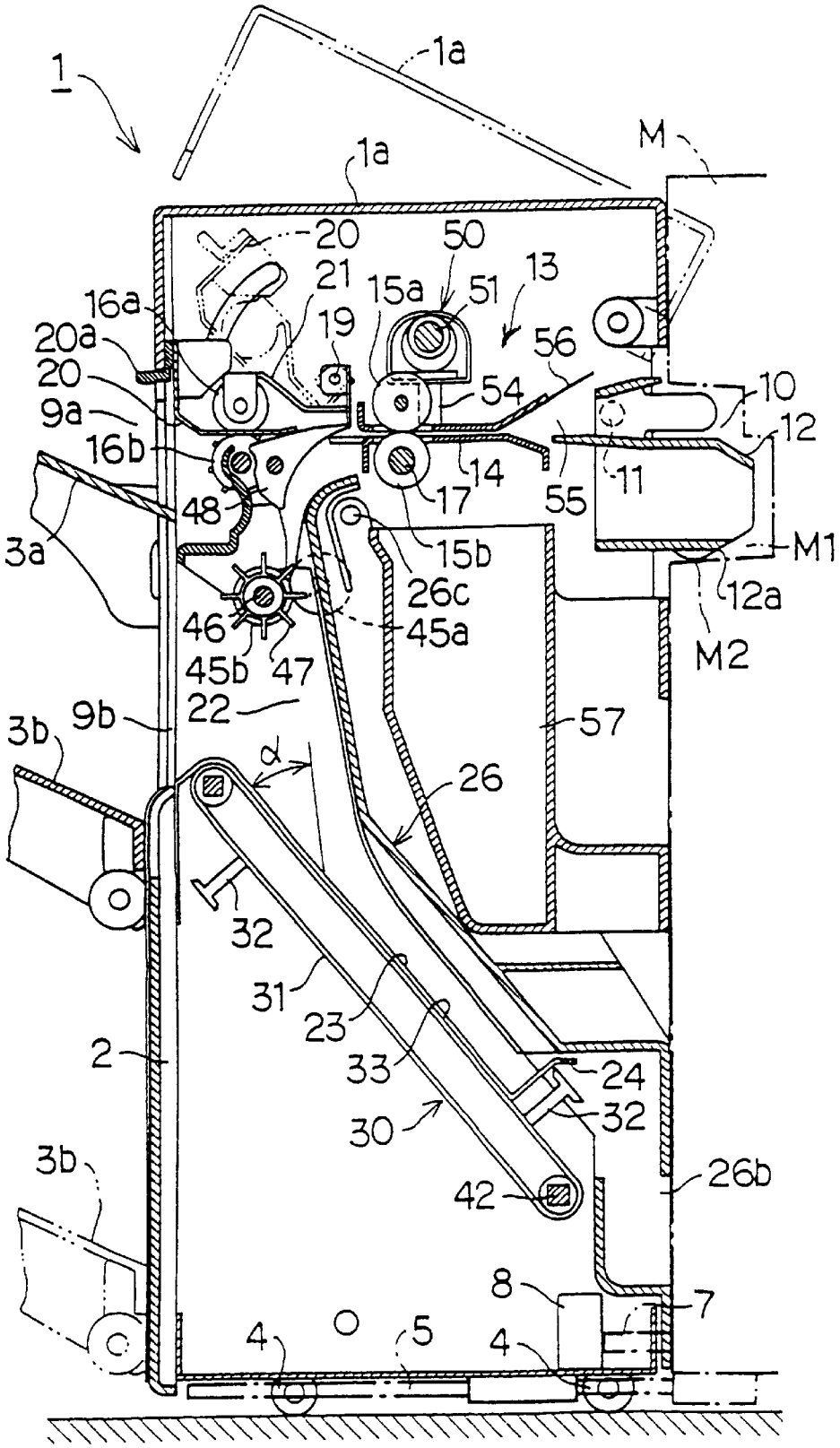
FIG. 1 is a vertical section of the post processor.
Figure 2:
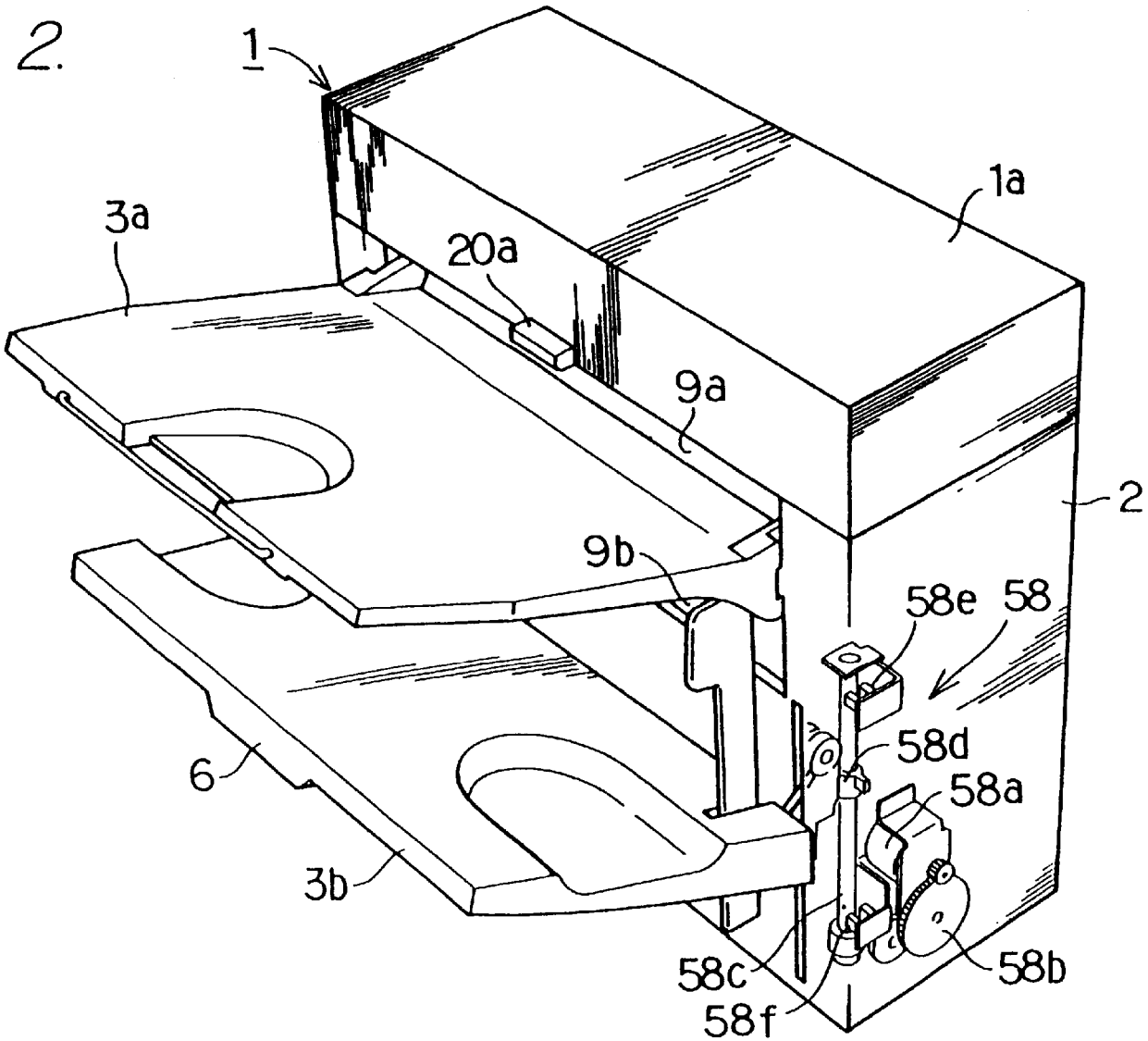
FIG. 2 is a partial perspective of the post processor.

The post processor 1 has an upper tray 3*a* and a lower tray 3*b* installed in parallel to the box-shaped body 2 as shown in FIG. 2. The post processor 1 and trays are installed on the output side of the image formation machine M as indicated by a dotted line in FIG. 1. The wheels 4 are installed on the bottom of the post processor 1 for moving, and the post processor can freely move to the extent that the wheels do not come off the rail 5 of the image formation machine M. The post processor 1 can be moved by the handle 6 provided in the front center of the aforementioned lower tray 3*b,* when collecting the later described punching wastes and removing the jammed sheets S. If the post processor 1 is moved by the handle 6 it can be balanced with pressure applied to the handle 6 even when the balance leans toward the tray due to the sheets placed on the tray. Therefore, the post processor 1 can be moved smoothly.

The post processor 1 has a safety switch 8, which turns on when pushed by the pin 7 of the image formation machine M. When the post processor 1 is disconnected from the image formation machine M, the safety switch 8 opens and automatically turns off the power of the post processor 1. By providing the safety switch 8, there is no risk of being electrocuted when working on the post processor 1 disconnected from the image formation machine M in comparison to the structure that manually turns the power on and off. There is also no simple mistake of forgetting to turn on the power when the post processor 1 is connected to the image formation machine M.

The opening cover 1*a* is located on the top of the post processor 1 as indicated by the two dotted lines in FIG. 1. The post processor 1 also has two support portions 9*a* and 9*b* for the upper tray 3*a* and the lower tray 3*b*.

Next, the internal structure of the post processor 1 will be explained. The infeed portion 10 for the sheet S is provided on the side that the post processor 1 connects to the image formation machine M almost at the same height as the output portion 9*a* of the aforementioned tray 3*a*. A swinging infeed guide 12 is supported around the short shaft 11 (refer to FIG. 1) in the infeed portion 10. The infeed guide 12 fits into the outlet M1 of the image formation machine M and stabilizes itself by placing its own cam side 12*a* on the step M2 of the aforementioned outlet M1. When the post processor 1 is disconnected from the image formation machine M, the infeed guide 12 loses its support and lowers the front end due to its own balance.

The paper path 13 is provided between the aforementioned infeed portion 10 and the output portion 9*a* on the top portion of the post processor 1. The paper path 13 roughly consists of a set of upper and lower sheet guides 14 leading to the aforementioned infeed guide 12, the first infeed rollers 15*a* and 15*b* in the middle of the sheet guides 14 and the second feed rollers 16*a* and 16*b* near the output portion 9*a*.

The upper roller 15*a* of the aforementioned first infeed rollers 15*a* and 15*b* is a so-called free rotating roller. The lower roller 15*b* is the driving roller that rotates counter-clockwise along with the rotating shaft 17 in FIG. 1. Both infeed rollers 15*a* and 15*b* transport the sheets S by putting the sheets S between them at the same speed as the sheet feed speed of the image formation machine M. The rotating shaft 17 of the aforementioned lower feed roller 15*b* has a known clutch mechanism that switches the feed roller 15*b* to both rotating and stopping conditions by disconnecting the transmission from the power source (not shown) when the clutch mechanism is activated. The clutch mechanism has a so-called one way structure that transmits the power in only one direction. If the reverse phenomenon that the transporting speed of the sheet S surpasses the feed speed of the infeed roller 15*b* occurs, the clutch mechanism switches the infeed roller 15*b* to move along with the sheet S.

The upper roller 16*a* of the feed rollers 16*a* and 16*b* is a free rotating roller. The lower roller 16*b* is the driving roller that rotates counter-clockwise around the rotating shaft 18 in FIG. 1. Both feed rollers 16*a* and 16*b* transport the sheet S by putting the sheets S between them at the same speed as the sheet feed speed of the image formation machine M. The upper feed roller 16*a* is installed on the movable sheet guide 20 that can freely swing around the hinge 19, th rough the spring arm 21. Therefore, the upper feed roller 16*a* can be opened with the sheet guide 20 if the sheets are jammed in the paper path 13 (as shown in broken lines in FIG. 4). The handle 20*a* is installed on the front edge of the sheet guide 20 and the top of the handle 20*a* is pushed outside from the bottom of the aforementioned cover 1*a*. Therefore, the cover 1*a* can also be opened by lifting up the edge of the sheet guide 20 by the handle 20*a*.

An inclined tray 23 is located in the area directly underneath the aforementioned paper path 13 through the later mentioned diverging path 22. The inclined tray 23 inclines to lift the edge of the aforementioned output portion 9*b* to be higher, and the sheet stopper 24 is located on the lower edge end of the tray 23. The inclination of the inclined tray 23 is such that the angle (refer to FIG. 1, hereinafter simply called the entering angle) of the sheet S and the higher side of the inclined tray 23 becomes acute when the sheet S sent from the later mentioned diverging path 22 touches the inclined tray 23.

The inclined tray 23 receives the sheets S and slips them to the bottom. Several ribs 25 (FIG. 7) are provided on the top of the inclined tray 23 to reduce friction with the sheet S. A tray guide 26 is located above the inclined tray 23, and several sheets S can be stored between the inclined tray 23 and the tray guide 26. Several ribs 27 (FIG. 8) are also formed on the surface of the tray guide 26 to reduce friction with the sheet S.

The adjustment unit 29 (FIGS. 6 and 7) that aligns the stored sheets S by putting one side of them to the permanent standard wall 28 on the other side is located on the inclined tray 23. The adjustment unit 29 consists of the L shaped sliding part 29*a* located on the opposite edge of the permanent standard wall 28 and the swinging arm 29*b* that moves the sliding part 29*a*. The sliding part 29*a* fits in the slit 23*a* formed on the inclined tray 23 and can slide straight back and forth directly across the feed direction of the sheet S. On the other hand, the swinging arm 29*b* swings back and forth within a certain range by the power source such as motors or solenoid (not shown). The sliding part 29*a* moves straight back and forth along with the swinging arm 29*b* between the solid line and the two dotted lines in FIG. 7. The leaf spring style cushion 29*c* is provided at the connection of the sliding part 29*a* and the swinging arm 29*b* as indicated by the broken line in FIG. 6. When the large pressure is applied to the sliding part 29*a,* the cushion 29*c* bends and prevents unnatural movements of the sliding part 29*a*.

Figure 5:
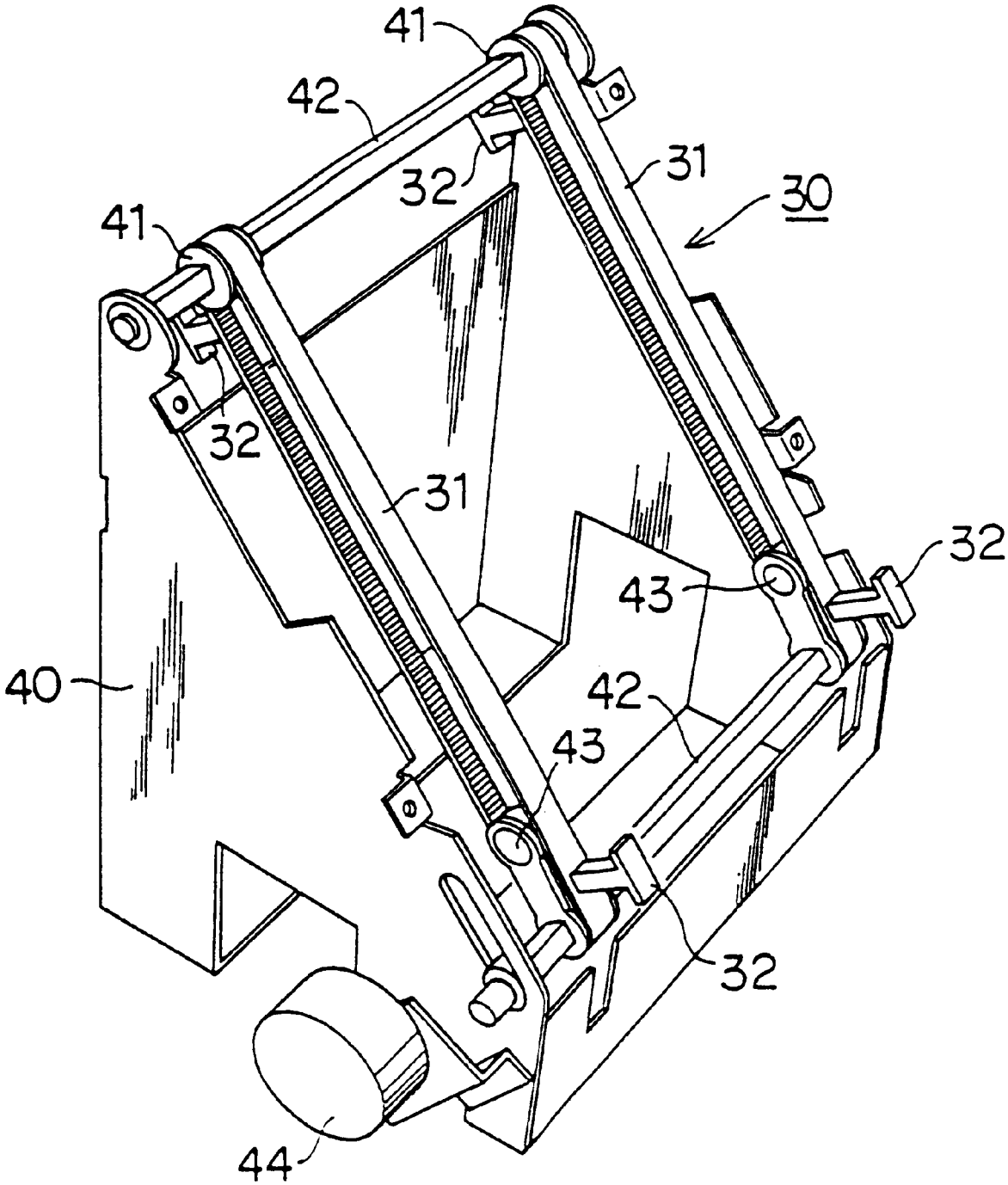
FIG. 5 is a perspective of the sheet transporting device below the inclined tray.
Figure 6:
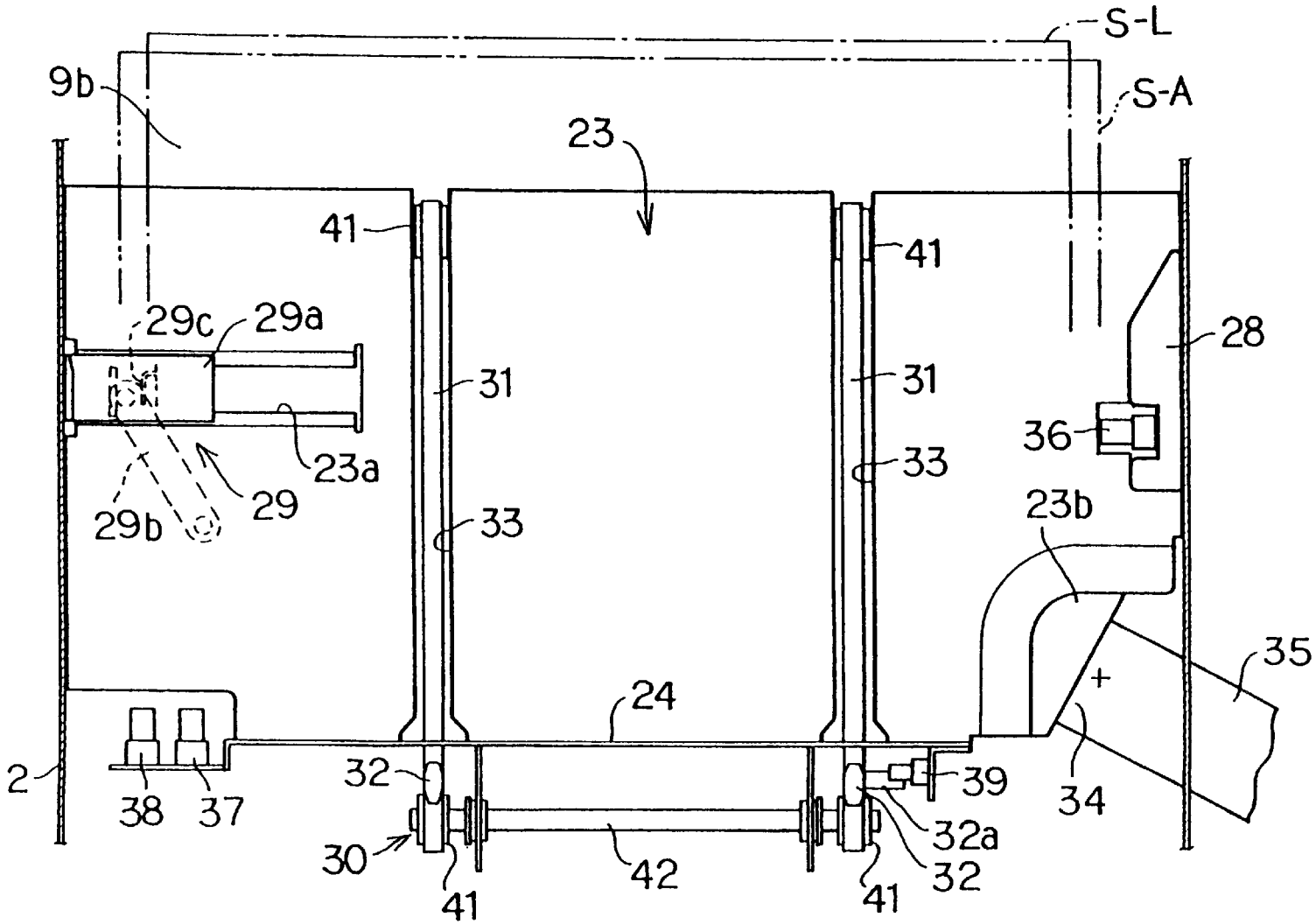
FIG. 6 is an X—X line section of FIG. 4.

Sheet transport means 30 as shown in FIGS. 5 and 6 is installed on the lower side of the inclined tray 23. The sheet transporting means 30 has the endless timing belt 31 that rotates along the bottom of the inclined tray 23 and the T-shaped pins 32 on the timing belt 31. It pushes out the drive pins 32 along the driving belts 33 on the inclined tray 23 and only the pins 32 are extend out on the top of the inclined tray 23 by the rotation of the timing belt 31. Two sets of the timing belts 31 and the driving belts 33 are located at transversely spaced intervals (FIG. 6) and two drive pins 32 push the sheet S placed on the top of the inclined tray 23 equally.

Two drive pins 32 are provided for each timing belt 31 and are pushed out on the top of the inclined tray 23 one by one in order to increase the efficiency of the timing belt 31 by eliminating unnatural movements. The drive pins 32 directly touch the edge of the sheet S and push it upwardly on tray 23. Since the drive pins 32 also push out the sheet S by directly touching the edge of the sheet S, the function can be completed by locating the key portion of the upside down T shaped drive pins to face the sheet S. However, the reasons why the drive pins 32 are purposely shaped like a T are to improve the productivity by enabling the installation in either direction as well as to prevent from producing malfunctioned products due to operational mistakes. The timing belt 31 of the sheet transporting means 30 is merely an example. Chains and strings can be used instead, or the drive pins 32 can be driven by a linear motor.

Figure 7:
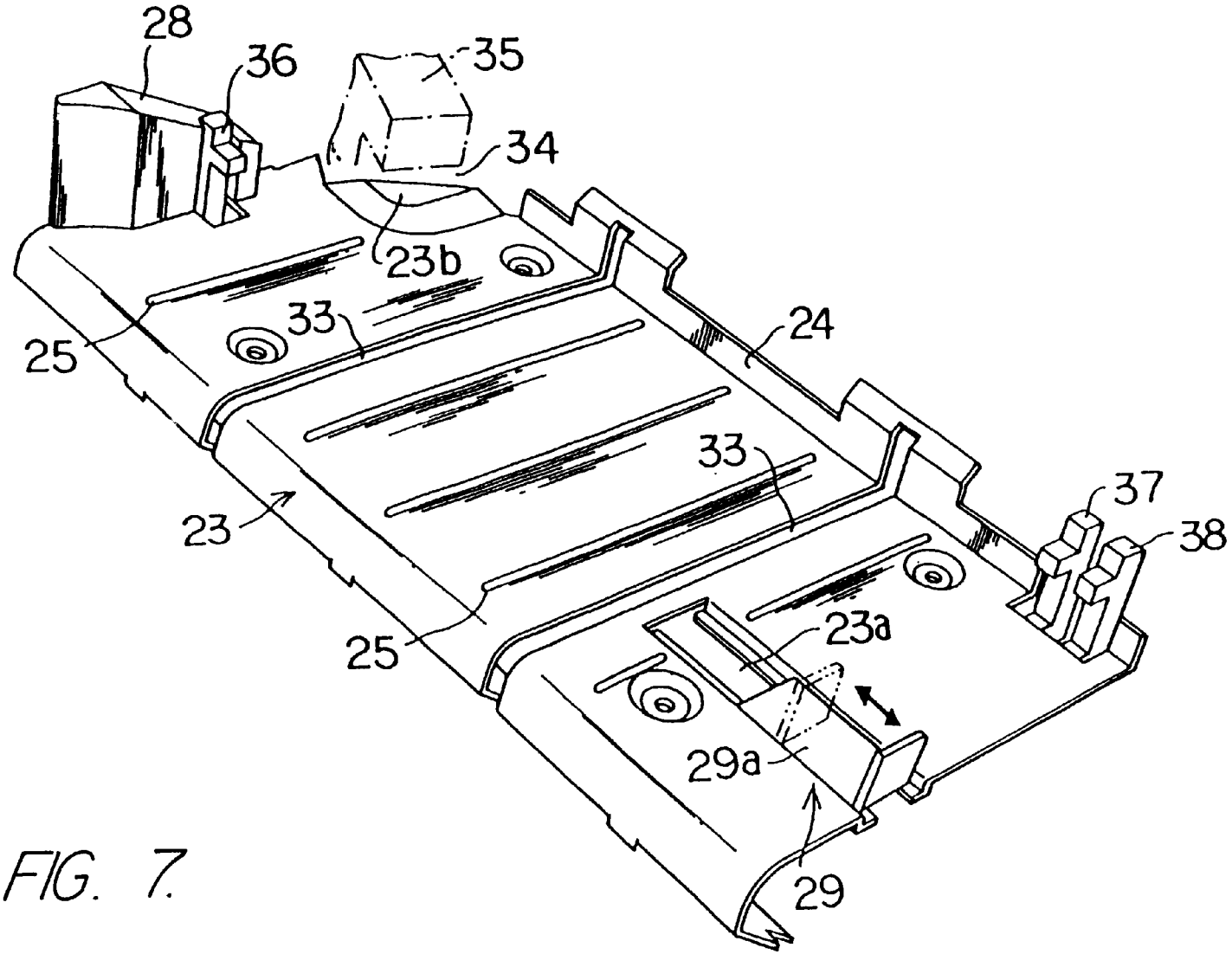
FIG. 7 is a perspective of the inclined tray.

The cut off portion 34 is provided on the corner of the sheet stopper 24 and on the inclined tray 23 as shown in FIGS. 6 and 7. The electric stapler 35 is installed on the body 2 at the side of the tray and fits in the cut portion 34. Therefore, it will be seen that the sheet transporting means 30 moves a batch of the sheets S to the binding point of the stapler 35 and temporarily stops the sheets S. Since the stapler 35 can be located close to the center of the body 2 by doing this, it is effective to minimize the size of the post processor 1.

Figure 8:
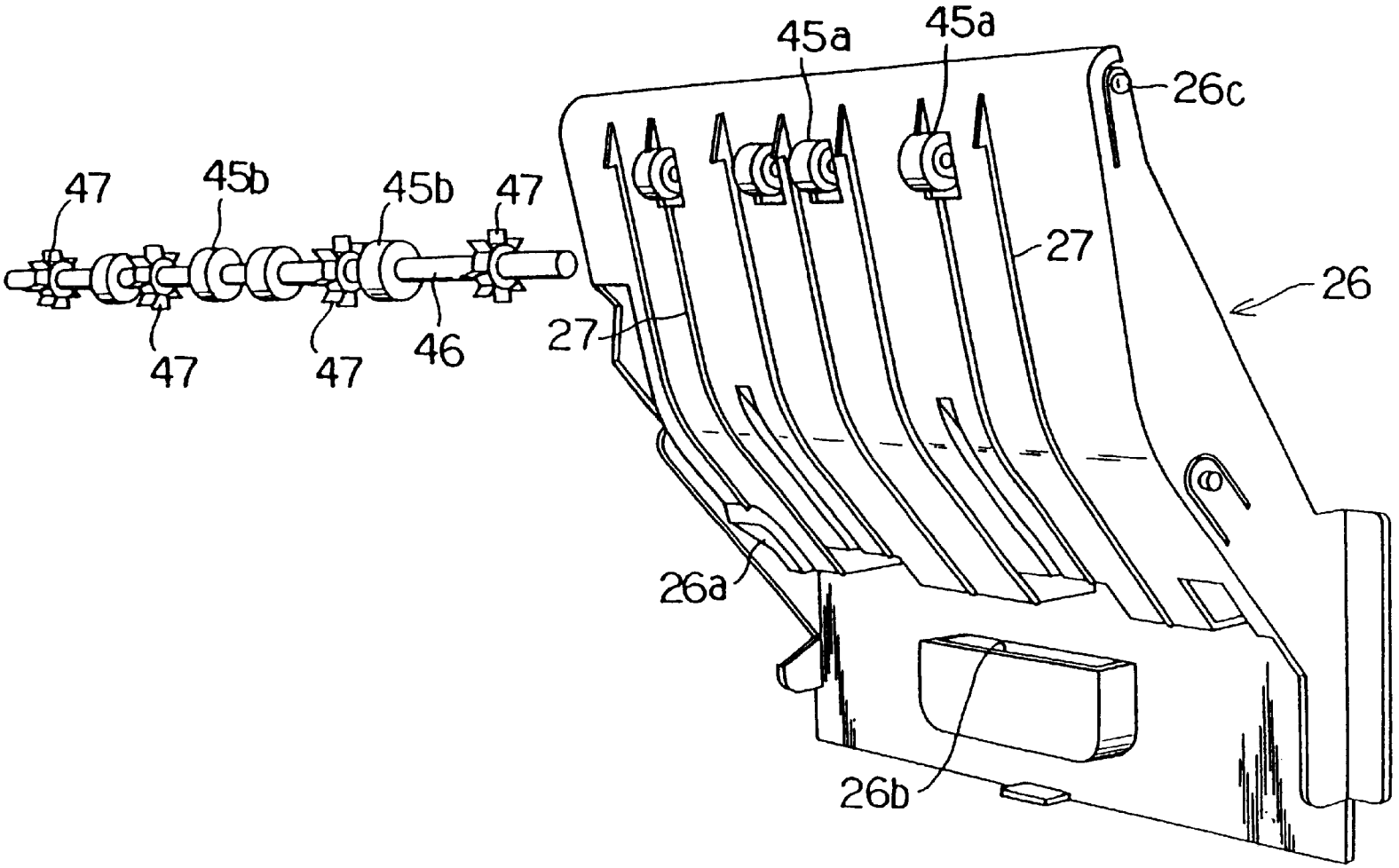
FIG. 8 is an exploded perspective indicating the tray guide and the feed rollers.

The upwardly deformed portion 23*b* of tray 23 is formed around the cut off portion 34 of the inclined tray 23 as shown in FIG. 7. The downwardly deformed portion 26*a* of the aforementioned tray guide 26 is formed in the opposite position from the portion 23*b* of the inclined tray 23, as shown in FIG. 8. The gap between the inclined tray 23 and the tray guide 26 is narrower than other portions because of portions 23*b* and 26*a* being closer together. The portions 23*b* and 26*a* do not have to be formed on both the inclined tray 23 and the tray guide 26, but on either one of them.

The number 36 in FIGS. 6 and 7 denotes a sheet sensor located on the fixed wall 28. It detects the sheet S by its signal and prevents the stapler 35 from activating when the sheets S are not properly positioned. The reference characters 37 and 38 are two sheet sensors located on the sheet stopper 24 and detect two paper sizes, which are the size of the sheet S indicated by two dotted lines S-L and S-A in FIG. 6 representing letter size and A4 sheet sizes, by matching each signal of both sensors 37 and 38. The reference character 39 designates the home position sensor of the drive pin 32. It detects the piece 32*a* (FIG. 6) provided on the drive pin 32 and stops it in the home position by controlling the timing belt 31 by its signal. Each of the aforementioned sensors 36–38 is an optical sensor in the operating form, but micro switches or lead switches can also be used.

The reference character 40 in FIG. 5 represents a support base for the sheet transporting means 30. A pulley 41 for the timing belts 31 are installed in shafts 42. Reference character 43 represents a tension for timing belt 31. Reference character 44 is a driving motor for the timing belt 31.

Figure 3:
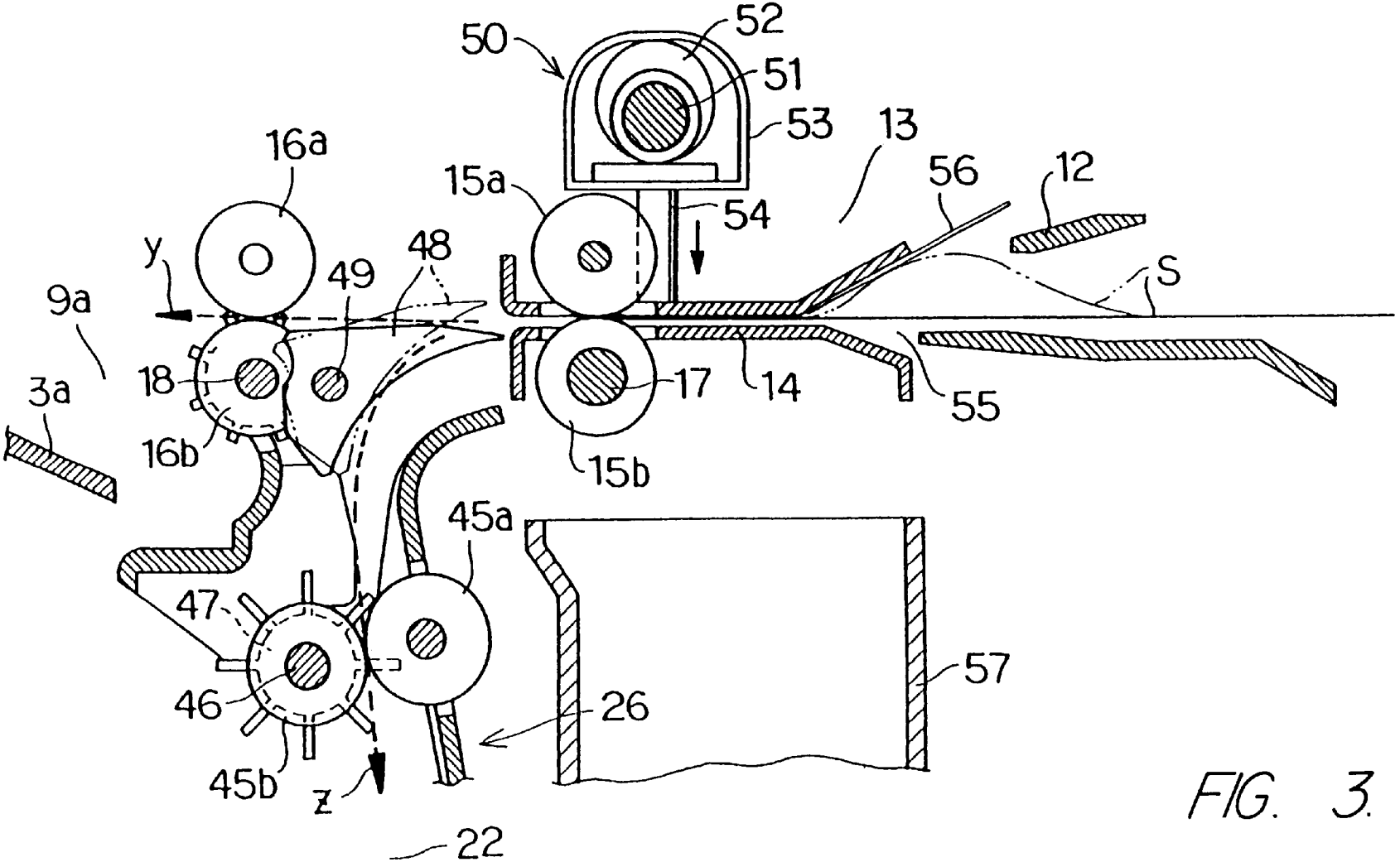
FIG. 3 is an enlarged section indicating the main portion of the feed path and a diverging path.
Figure 4:
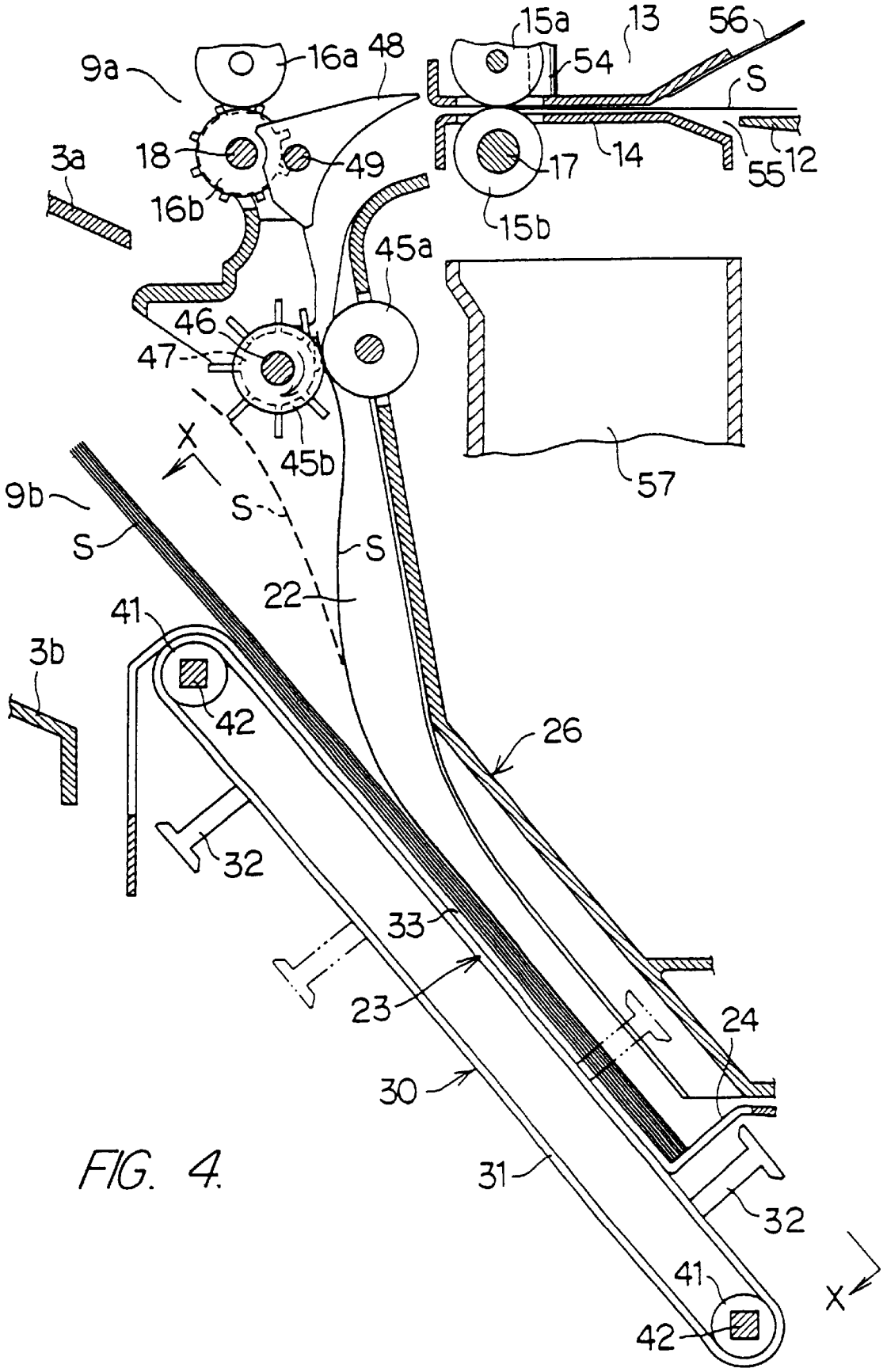
FIG. 4 is an enlarged section indicating the main portion of the diverging path and an inclined tray.

As shown in FIGS. 1, 3 and 4, the sheet diverting path 22 is formed between the paper path 13 and the inclined tray 23. This diverting path 22 consists of the upper half portion of the aforementioned tray guide 26 and the diverter feed means located across the tray guide 26 and the body 2. The diverter feed means are the high speed rollers 45*a* and 45*b* installed on the tray guide 26 and the body 2. The rollers 45*a* of the high speed rollers 45*a* and 45*b* are attached to the tray guide 26 (FIG. 8) and are free rotating rollers. The other rollers 45*b* are the power rollers that rotate counter-clockwise with the rotating shaft 46 in FIG. 4. Both high speed rollers 45*a* and 45*b* put the sheet S between them and transport them at higher speed (say, approximately twice as high in an operating mode) than the sheet feeding speed of the aforementioned feed rollers 15*a* and 15*b* (= the sheet feed speed of the image formation machine M). The high speed roller 45*a* attached to the tray guide 26 is installed on the same type of the spring arm that is used to install the aforementioned feed roller 16*a* and touches the high speed roller 45*b* by a specified pressure.

The installation positions of the high speed rollers 45*a* and 45*b* in the diverting path 22 is set up so that the distance between the connection of the high speed rollers 45*a* and 45*b* and the sheet stopper 24 of the inclined tray 23 is shorter than the length of the sheet. Therefore, when the front end of the sheet S reaches the sheet stopper 24, the rear end of the sheet S is still remained in the high speed rollers 45*a* and 45*b*. Therefore, the high speed rollers 45*a* and 45*b* continue to feed out the rear end of the sheet S as they bend it, the resilient ribs of the later mentioned runner 47 push the trailing end of the sheet further, and the front end of the sheet S is caused to touch the sheet stopper 24 (FIG. 4).

The runner 47 with several resilient ribs is permanently installed around the rotating shaft 46 of the high speed roller 45*b* as shown in the FIGS. 4 and 8. The ribs of the runner 47 are elastic and bend easily when they touch the surface of the sheet as indicated by a broken line in the FIG. 4. The runner 47 always rotates with the rotating shaft 46 and drives the rear end of the sheet S toward the top of the tray 23 in the moment that the rear end of the sheet S comes out of the high speed rollers 45*a* and 45*b* (as shown in broken lines in FIG. 4).

A pivoted diverter or gate 48 is located in the middle of the aforementioned paper path 13 between the infeed rollers 15*a* and 15*b* and the bypass rollers 16*a* and 16*b*. This diverter 48 is connected to solenoid (not shown) by a shaft 49. It opens the path of the paper path 13 by lowering its edge when solenoid is magnetized as indicated by a solid line in FIG. 3. It opens the flow path of the diverging path 22 by lifting its edge when solenoid is demagnetized as indicated by a broken line in FIG. 3. Switching of paper paths by the diverter 48 is an alternative. The switch gate 48 closes the diverter path 22 when the paper path 13 is opened, and on the contrary, closes the paper path 13 when the diverter path 22 is opened.

A punch 50 is disposed in the paper path 13 in advance of the switch gate 48. The punch 50 is publicly known to move the punch blade 54 attached to the cam follower 53 up and down by the eccentric cam attached to the rotating shaft 51. The aforementioned infeed rollers 15*a* and 15*b* function to be the gate means to stop the front end of the sheet S when the punch 50 is activated, that is to stop feeding the sheet S by stopping the rotation of the infeed rollers 15*a* and 15*b* when the punch 50 is activated. For example, a shutter type part that opens and closes the paper path 13 can be installed in the middle of the paper path 13 instead of using the infeed rollers 15*a* and 15*b* as a gate means. However, in this case, since the gate means is separately installed, it becomes a factor of the higher cost. In other words, the punch 50 provided above with the infeed rollers 15*a* and 15*b*, stop the sheet S by stopping the infeed rollers 15*a* and 15*b* and the sheets S are punched by activating the punch 50 in that condition. Therefore, the sheet stopper for the punch 50 does not need to be installed separately, this way the low cost can be maintained.

Figure 9:
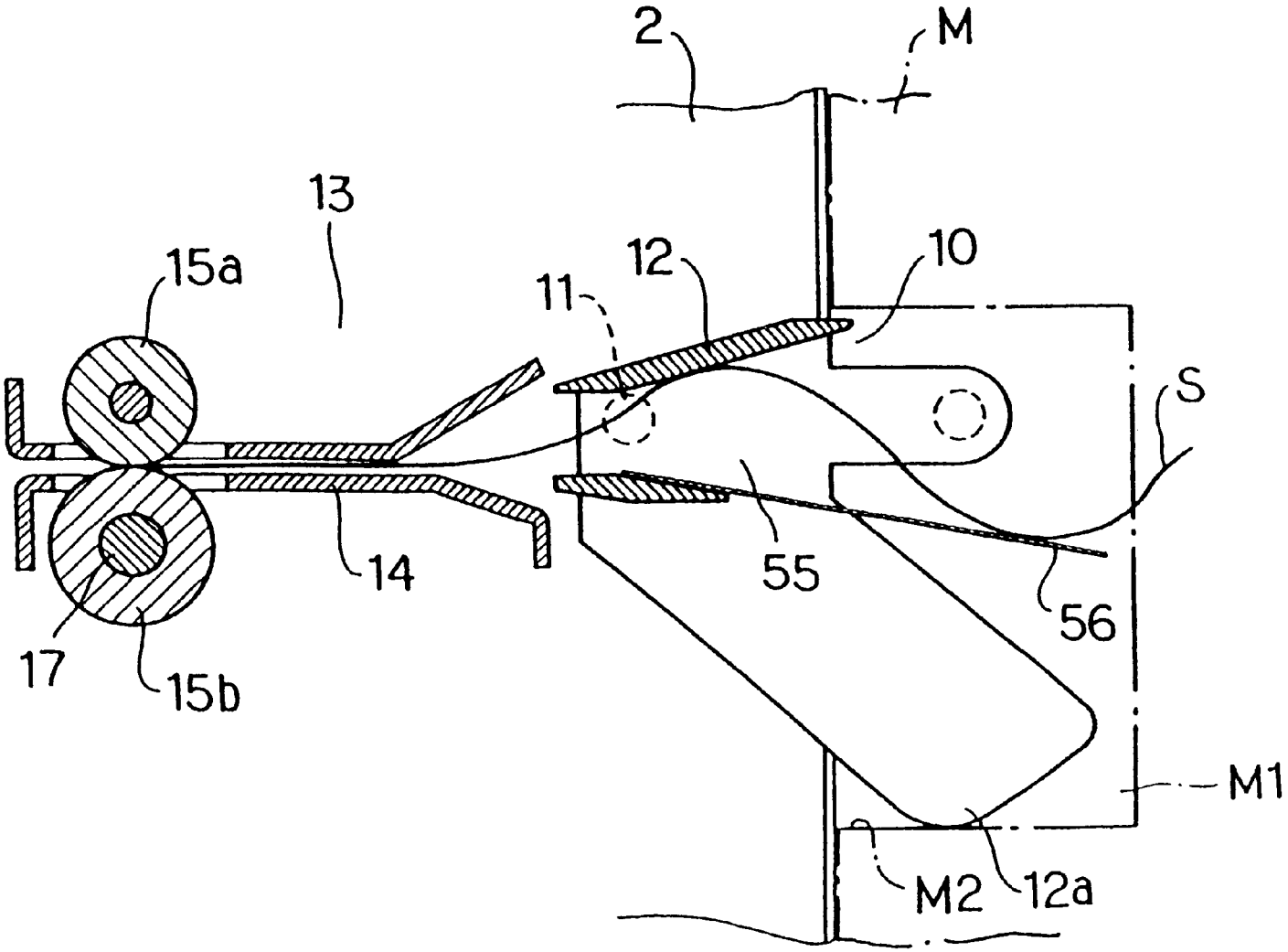
FIG. 9 is an enlarged section of the main portion of the infeed portion indicating another form of the free space.

As seen in FIG. 9, in relation to the punch 50, a free space 55 between guides 12 that enables to bend the sheets S is in front of the punch 50, which is between the punch 50 and the outlet M1 of the image formation machine M. The free space 55 can be formed, for example, between the infeed guide 14 and the infeed guide 12 as shown in FIG. 3 or between the infeed guide 12 and the outlet M1 as shown in FIG. 9 or can also be formed by combining FIGS. 3 and 9 (not shown). The minimum size required for the free space 55 is determined based on how many pieces of the sheet S are sent from the image formation machine M when the front end of the sheet S is stopped during the operation of the punch 50 as mentioned later.

As seen in FIG. 3, an elastic synthetic resin board 56 is located in the free space 55 and the sheet S pushes and curves it when the sheet S bends with a big loop. By doing so, the bent sheet S does not wrinkle easily.

Also, as seen in FIG. 3, a box 57 for punching waste of the punch 50 is installed under the paper, path 13 next to the tray guide 26.

As mentioned earlier, the upper tray 3*a* and the lower tray 3*b* that receive the sheets S are located in the output portions 9*a* and 9*b*. The upper tray 3*a* can be detached from the body 2, but it does not move when it is installed in a permanent position. On the contrary, the lower tray 3*b* can be detached from the body 2 and shifts its position up and down according to the number of sheets placed on it. That is, the lower tray 3*b* is connected to the elevator means 58 as seen in FIG. 2. The elevator means consists of the motor 58*a*, the gears 58*b*, the screw shaft 58*c* and the elevating arm 58*d* as shown in FIG. 2. It detects the weight of the sheets S placed on the lower tray 3*b* by a sensor (not shown) and moves up and down to maintain a constant level of the sheets S by controlling the aforementioned motor 58*a* by its signal. The sensors 58*e* and 58*f* are provided in the elevator device 58 and detect the upper and lower thresholds of the elevating arm 58*d*.

The operation of the post processor 1 is as follows. As mentioned earlier, the post processor 1 is installed on the output side of the image formation machine M and turns on when the pin 7 pushes the safety switch 8 of the image formation machine M.

The sheets S are discharged from the image formation machine M into paper path 13. Since the switch gate 48 usually closes the feed path by lifting its front end as indicated by a two dotted line in FIG. 3, it lowers the front edge of the switch gate 48 by magnetizing solenoid as indicated by a solid line in the same figure, and it opens the paper path 13. Then, the sheets S discharged from the image formation machine M will be discharged onto the upper tray 3*a* after going into the infeed rollers 15*a* and 15*b* and then to the feed rollers 16*a* and 16*b* as shown by the arrow Y in FIG. 3.

To perforate the sheet S, the perforator stops the infeed roller 15*b* first and then stops the front end of the sheet S discharged from the image formation machine M. In this condition, if the punch moves the puncher blade 54 up and down with one rotation of the eccentric cam 52, it punches holes on the edge of the sheet S. On the other hand, the latter half of the sheet S continues to be fed from the image formation machine M, while the front of the sheet is punched by activating the puncher 50, but the center of the sheet S bends to the extent that the length of the sheets are fed during that period as indicated by a broken line in FIG. 3 and they move into the free space 55. The punching application is completed before the sheet S fills the free space 55 and the infeed roller 15*b* rotates and sends the sheets S to the feed rollers 16*a* and 16*b*.

Punching wastes drop into and are stored in the box 57 underneath the perforator 50. Therefore, they need to be collected and disposed regularly. In that case, pull the post processor 1 by the handle 6 of the lower tray 3*b* and remove the box 57 by disconnecting the post processor 1 from the image formation machine M.

The diverter gate 48 normally opens the flow path of the diverter path 22 by lifting its front edge as indicated by a two dotted line in FIG. 3. Therefore, the sheets S discharged from the image formation machine M are sent to the infeed rollers 15*a* and 15*b* and then to the high speed rollers 45*a* and 45*b* through the diverter gate 48 as indicated by the arrow Z in FIG. 3. As mentioned earlier, the speed of the high speed rollers 45*a* and 45*b* is set up to be higher than the sheet feeding speed of the infeed rollers 15*a* and 15*b*. The front end of the sheet S is immediately pulled in at high speed as soon as it is nipped between the high speed rollers 45*a* and 45*b*. At this point, the rear end of the sheet S is placed between the infeed rollers 15*a* and 15*b*. However, since the one-way clutch mechanism is installed between the infeed roller 15*b* and the power source, the infeed roller 15*b* automatically switches to be the free roller that moves along with the sheets S in the period that the transporting speed of the sheet S surpasses its own input speed.

If the infeed rollers 15*a* and 15*b* pull the sheet S almost at the same speed as the input speed of the image formation machine M, the sheet transporting speed of the high speed rollers 45*a* and 45*b* downstream from the infeed rollers 15*a* and 15*b* is set up to be higher than the speed of the infeed rollers, and the aforementioned one way clutch mechanism is incorporated into the infeed roller 15*b*, the sheets S that are synchronized and fed at low speed into the formation machine M can be processed at high speed inside of the post processor 1. Of course, the speed of the feed rollers 16*a* and 16*b* in the paper path 13 can be set up to be higher than the speed of the infeed rollers 15*a* and 15*b*. In this case, the loss of time made by the punching operation can be recovered by transporting the sheets S at high speed.

When the divergent path to tray 23 is opened, the front end of the sheet S reaches inclined tray 23 naturally flows toward the sheet stopper 24 along the inclination of the inclined tray 23 because the entering angle of the sheet S and the inclined tray 23 is acute. At this stage, front and back of the sheet S are inverted. The front end of the sheet S is fed by the high speed rollers 45*a* and 45*b* and immediately reaches at the sheet stopper 24. As mentioned earlier, since the installation positions of the high speed rollers 45*a* and 45*b* are located so that the distance between the connection of the high speed rollers 45*a* and 45*b* (a release point) and the sheet stopper 24 of the inclined tray 23 is shorter than the length of the sheet, the rear end of the sheet S is still remained in the high speed rollers 45*a* and 45*b* even when the front end of the sheet S reaches at the sheet stopper 24. Therefore, the sheets S bend softly and come out of the high speed rollers 45*a* and 45*b*, as shown in FIG. 4. Since the runner 47 is mounted around the rotating shaft 46 of the high speed roller 45*b* and rotates with the high speed roller 45*b*, the rear end of the sheet S is kicked out onto the inclined tray 23 in the moment that the rear end of the sheet S comes out of the high speed rollers 45*a* and 45*b* as indicated by a broken line in FIG. 4.

Then, the timing belt 31 of the sheet transporting means 30 activates and the drive pin 32 pushes the sheets S along the driving line 33 of the inclined tray 23. When the timing belt 31 rotates half way, the sheets S are discharged onto the lower tray 3*b* and stop when the drive pin 32 waits at a home position. If the sheets S are jammed in the diverter path 22 or on the inclined tray 23, disconnect the post processor 1 can be disconnected from the image formation machine M by the handle 6 of the lower tray 3*b* first and pull the tray guide 26 by the pick up portion 26*b* after removing the box 57 for punching wastes. The jammed sheets S can be easily removed since the tray guide 26 rotates around the upper hinge 26c (see FIGS. 1 and 8) and opens.

Binding several sheets will now be described. First, the sheets S are sent onto the inclined tray 23 one by one from the first page as mentioned earlier. In this case, the sheets S are continuously sent to be processed at high speed. Since the runner 47 kicks out the rear end of the sheets S discharged from the high speed rollers 45*a* and 45*b* onto the inclined tray 23 as mentioned earlier, the rear end of the sheet S and the front end of the following sheet S never touch each other.

Each time the sheet S is sent onto the inclined tray 23, the jogging unit 29 activates once and the sliding part 29*a* moves back and forth once to move each sheet. When the number of the sheets increases, the gap between the portions 23*b* and 26*a* becomes narrower and it becomes difficult to send the sheet S. However, since the swelled portions 23*b* and 26*a* are partial and small, the resistance is relatively small. When the specified number of sheets are sent, the drive pins 32 of the sheet transporting means 30 are activated and transport a batch of the sheets S to the binding point of the stapler 35 and stops. Then, the stapler 35 is activated and binds the batch of the sheets S with metal staples. At this point, the batch of the sheets S is compressed by the portions 23*b* and 26*a*, it is easy to be stapled.

Then, the drive pins 32 of the sheet transporting means 30 are activated again and discharge the bound batch of the sheets S onto the lower tray 3*b*. The drive pins 32 are designed to transport the sheets S initially at high speed and to decrease the speed before discharging them onto the lower tray 3*b*. By doing so, the sheets S never jump out of the lower tray 3*b*. The lower tray 3*b* can move up and down as mentioned earlier. It descends when the sheets are placed on the tray and automatically ascends when the sheets S are removed from it.

It is needless to say that the punch 50 can perforate the edge of the sheet S even when several sheets S are stapled by being rotated.

Refilling of the metal staples in the stapler 35 should be done by disconnecting the post processor 1 from the image formation machine M.

In another form, this invention has a feature that both high speed rollers 45*a* and 45*b* are driving rollers. That is, fix a gear (not shown) to the edge of the rotating shaft by stabilizing the full high speed roller 45*a* to one rotating shaft. On the other hand, also fix a gear (not shown) to the edge of the rotating shaft 46 of the other high speed roller 45*b*. Both gears rotate the high speed roller 45*a* in the opposite direction from the high speed roller 45*b* at the same rotation speed. When the high speed rollers 45*a* and 45*b* grips the sheet S between them as mentioned earlier, they may slip at first due to the resistance because the rear end of the sheet S is remained in the infeed rollers 15*a* and 15*b*. However, if both high speed rollers 45*a* and 45*b* are driving rollers like in this operation form 2, the high speed rollers 45*a* and 45*b* can send the sheet accurately and pull them by the strong force.

By setting up both high speed rollers 45*a* and 45*b* to be driving rollers, the incidents can be prevented when the post processor 1 is not used for a long period of time. That is, since the high speed rollers 45*a* and 45*b* have rubber-like elastic structures, the contacting parts become flat and their shapes become distorted causing the sheet infeed to be unstable when the high speed rollers 45*a* and 45*b* are not used for a long period of time while the strong pressure is applied to them. If both high speed rollers 45*a* and 45*b* are driving rollers, the gap between both high speed rollers becomes narrower than the thickness of the sheets S and both high speed rollers do not touch. If both high speed rollers do not touch, their shapes will not be distorted even when they are not used for a long period of time. However, the thickness of the sheets S is actually extremely thin, it is difficult for the high speed rollers 45*a* and 45*b* not to touch and actually they touch slightly. If they only touch slightly, the degree of shape distortion is small enough not to cause any operational problems.

Both infeed rollers 15*a* and 15*b* should also be driving rollers that consists of the gate means. That is, gears (not shown) are fixed to the edge of the rotating shaft of the upper roller 15*a* and the rotating shaft 17 of the lower roller 15*b* and both gears rotate the upper roller 15*a* in the opposite direction from the lower roller 15*b* at the same rotation speed. The difference between the driving rollers and the free rollers is that when the sheets S collide tangentially while rollers are stopping, the free rollers slightly rotate when pushed by the sheets S, but the driving rollers do not rotate when pushed by the sheets S because they are connected to the driving source and have resistance. Therefore, by setting up both infeed rollers 15*a* and 15*b* to be driving rollers, they can close the gate more strongly, and as a result, the stop position of the sheet S becomes constant and therefore the punching accuracy improves. Although the rotating shaft 17 of the lower infeed roller 15*b* has a clutch mechanism as mentioned earlier, the clutch function of the rotating shaft 17 directly applies to the upper infeed roller 15*a*.

By setting up both infeed rollers 15*a* and 15*b* to be driving rollers, the incidents can be prevented when the post processor 1 is not used for a long period of time like the aforementioned high speed rollers 45*a* and 45*b*.

As mentioned earlier, since the post processor of this invention locates the high speed rollers behind the infeed rollers and also provides the one way structure clutch mechanism in the infeed rollers, the high speed rollers can easily transport the sheets, which were taken in at the transporting speed of the image formation machine, at high speed. Therefore, it can conduct the specified post processing without disturbing the sheet output timing of the image formation machine.

As mentioned in the application item 2, if the high speed rollers are provided with two driving rollers facing each other, they can send sheets more accurately and their shapes do not change when they are left unused for a long period of time because they do not need to firmly touch each other.

What is claimed is:

1. A post processor for receiving printed sheets supplied from an image forming machine: comprising means defining a horizontally extended sheet feed path having an entry and exit for sheets entering and exiting the post processor, stoppable infeed roll means forming a gate for stopping the leading edge of a sheet passing through said feed path, sheet punching means adjacent to said gate and between said gate and the entry for sheets into said feed path, a clearance space between said sheet punching means and the entry of sheets into said feed path for permitting a sheet to bow when the leading edge is stopped by said gate, means for activating said sheet punching means when said sheet is stopped to form holes therein adjacent the leading edge, and means for rotating said stoppable feed roller means following activation of said sheet punching means to allow passage of a sheet therebetween, and including high speed output feed roll means in said feed path after said stoppable infeed roll means operable at a speed greater than said stoppable infeed roll means to carry the sheets at a relatively high speed in said feed path following activation of said sheet punching means and pull the sheets through said stoppable infeed roll means, and means for receiving sheets fed by said output feed roll means, said feed path being divergent horizontally and downwardly downstream from said gate and including first high speed output roll means to feed sheets horizontally to said means for receiving sheets, and second high speed output roll means for feeding sheets downwardly to a downwardly inclined tray directly below said feed path, a diverter to direct said sheets to said first and second output roll means, selectively, and means for stapling sets of sheets directed on to said downwardly inclined tray.

2. A post processor for receiving printed sheets supplied from an image forming machine: comprising means defining a sheet feed path having an entry and an exit for sheets entering and exiting the post processor, gate means for stopping the leading edge of a sheet passing through said feed path, sheet punching means between said gate means and the entry for sheets into said feed path, means for activating said punch means when said sheet is stopped to form holes therein, and means for actuating said gate means to pass sheets following activation of said punch means, said feed path being divergent horizontally and downwardly downstream from said gate means and including output roll means to feed sheets selectively from said apparatus to an external horizontally extended receiver or vertically downwardly, diverter means in said feed path for directing sheets to said external receiver or vertically downwardly, and including a downwardly inclined sheet receiving tray directly below said divergent feed path having a stopper at its lower end, sheet transport feed rolls between said diverter and the upper end of said inclined tray, the distance between said sheet transport feed rolls and said stopper being shorter than the length of a sheet supplied to said stopper, including a stapler located at one side and at the lower end of said inclined tray, and means for jogging the sheets on said tray and moving said sheets into position for stapling by said stapler.

3. A post processor for receiving printed sheets supplied from an image forming machine as defined in claim 2, including a kick out member associated with said sheet transport rolls for kicking out the trailing end of said sheet onto said tray.

4. A post processor for receiving printed sheets supplied from an image forming machine as defined in claim 2, including a sheet guide associated with said inclined tray and forming therewith a narrow gap for compressing the corners of said sheets in said stapler.

5. A post processor for receiving printed sheets supplied from an image forming machine as defined in claim 2, including sheet drive means having belts and drive pins for moving stapled sets of sheets upwardly from said inclined tray, and stacker means for receiving said sets of sheets.

* * * * *